US006658862B2

(12) United States Patent
Swift et al.

(10) Patent No.: US 6,658,862 B2
(45) Date of Patent: Dec. 9, 2003

(54) CASCADED THERMOACOUSTIC DEVICES

(75) Inventors: Gregory W. Swift, Santa Fe, NM (US); Scott N. Backhaus, Espanola, NM (US); David L. Gardner, Los Alamos, NM (US)

(73) Assignee: The Regents of the University of California, Los Alamos, NM (US)

( * ) Notice: Subject to any disclaimer, the term of this patent is extended or adjusted under 35 U.S.C. 154(b) by 0 days.

(21) Appl. No.: 10/125,268

(22) Filed: Apr. 18, 2002

(65) Prior Publication Data

US 2003/0196441 A1 Oct. 23, 2003

(51) Int. Cl.[7] ..... F25B 9/00
(52) U.S. Cl. ..... 62/6
(58) Field of Search ..... 62/6

(56) References Cited

U.S. PATENT DOCUMENTS 4,355,517 A 10/1982 Ceperley ..... 60/721
4,489,553 A 12/1984 Wheatley et al. ..... 60/516
4,722,201 A * 2/1988 Hofler et al. ..... 62/6
5,167,124 A * 12/1992 Lucas ..... 62/6
5,319,948 A * 6/1994 Blum et al. ..... 62/6
5,515,684 A * 5/1996 Lucas et al. ..... 62/6
5,901,556 A * 5/1999 Hofler ..... 62/6
6,109,041 A * 8/2000 Mitchell et al. ..... 62/6
6,389,819 B1 5/2002 Zhu et al. ..... 62/6

* cited by examiner

*Primary Examiner*—William C. Doerrler
(74) *Attorney, Agent, or Firm*—Ray G. Wilson

(57) ABSTRACT

A thermoacoustic device is formed with a resonator system defining at least one region of high specific acoustic impedance in an acoustic wave within the resonator system. A plurality of thermoacoustic units are cascaded together within the region of high specific acoustic impedance, where at least one of the thermoacoustic units is a regenerator unit.

18 Claims, 8 Drawing Sheets

CASCADED THERMOACOUSTIC DEVICES

STATEMENT REGARDING FEDERAL RIGHTS

This invention was made with government support under Contract No. W7405-ENG-36 awarded by the U.S. Department of Energy. The government has certain rights in the invention.

FIELD OF THE INVENTION

The present invention relates generally to oscillating wave engines and refrigerators, and, more particularly, to thermoacoustic engines and refrigerators, including Stirling engines and refrigerators and their hybrids.

BACKGROUND OF THE INVENTION

According to thermodynamic principles, acoustic power in a gas—a nonzero time average product of oscillating pressure and oscillating volume flow rate—is as valuable as other forms of work such as electrical power, rotating shaft power, and hydraulic power. For example, acoustic power can be used to produce refrigeration, such as in orifice pulse tube refrigerators; it can be used to produce electricity, via linear alternators; and it can be used to generate rotating shaft power, e.g., with a Wells turbine. Furthermore, acoustic power can be created from heat in a variety of heat engines such as Stirling engines and thermoacoustic engines.

Historically, Stirling's hot-air engine of the early 19th century was the first heat engine to use oscillating pressure and oscillating volume flow rate in a gas in a sealed system, although the time-averaged product thereof was not called acoustic power. Since then, a variety of related engines and refrigerators have been developed, including Stirling refrigerators, Ericsson engines, orifice pulse-tube refrigerators, standing-wave thermoacoustic engines and refrigerators, free-piston Stirling engines and refrigerators, and thermoacoustic-Stirling hybrid engines and refrigerators. Combinations thereof, such as the Vuilleumier refrigerator and the thermoacoustically driven orifice pulse tube refrigerator, have provided heat-driven refrigeration.

Much of the evolution of this entire family of acoustic-power thermodynamic technologies has been driven by the search for higher efficiencies, greater reliabilities, and lower fabrication costs. FIGS. 1, 2, and 3 show some prior art engine examples.

FIG. 1 shows a free-piston Stirling engine 10 integrated with a linear alternator 12 to form a heat-driven electric generator. High-temperature heat, such as from a flame or from nuclear fuel, is added to the engine at the hot heat exchanger 14, ambient-temperature waste heat is removed from the engine at the ambient heat exchanger 16, and oscillations of the gas 18, piston 22, and displacer 24 are thereby encouraged. The oscillations of piston 22 cause permanent magnet 26 to oscillate through wire coil 28, thereby generating electrical power which is removed from the engine to be used elsewhere.

The conversion of heat to acoustic power occurs in regenerator 32, which is a solid matrix smoothly spanning the temperature difference between hot heat exchanger 14 and ambient heat exchanger 16 and containing small pores through which the gas oscillates. The pores must be small enough that the gas in them is in excellent local thermal contact with the solid matrix. Proper design of the dynamics of moving piston 22 and displacer 24, their gas springs 34/36, and gas 18 throughout the system causes the gas in the pores of regenerator 32 to move toward hot heat exchanger 14 while the pressure is high and toward ambient heat exchanger 16 while the pressure is low. The oscillating thermal expansion and contraction of the gas in regenerator 32, attending its oscillating motion along the temperature gradient in the pores, is therefore temporally phased with respect to the oscillating pressure so that the thermal expansion occurs while the pressure is high and the thermal contraction occurs while the pressure is low.

Those skilled in the art understand that another way to view the operation of the free-piston Stirling engine, and indeed all regenerator-based engines including all Stirling and traveling-wave engines, is that acoustic power flows into the ambient end of the regenerator, is amplified in the regenerator by a temperature gradient in the regenerator, and flows out of the hot end of the regenerator. Ideally, the heat exchangers at the ends of the regenerator are essentially transparent to this acoustic power flow. Ideally, the acoustic-power amplification factor in the regenerator is equal to the ratio of hot temperature to ambient temperature, both temperatures being measured in absolute units such as Kelvin.

In the free piston Stirling engine of FIG. 1, the acoustic power flowing out of the hot end of regenerator 32 is absorbed from the gas by the hot end of displacer 24 and immediately delivered to the gas at the opposite end of displacer 24. There, some of the acoustic power flows into the ambient end of regenerator 32 to provide the original acoustic power for amplification, and the rest is delivered by gas 18 to piston 22. Hence, circulating acoustic power flows through the regenerator from ambient to hot temperatures and is amplified therein.

FIG. 2 shows another regenerator-based engine: a thermoacoustic-Stirling hybrid engine delivering acoustic power to an unspecified load 42 (e.g., a linear alternator or any of the aforementioned refrigerators) to the right. High-temperature heat, such as from a flame, from nuclear fuel, or from ohmic heating, is added to the engine at hot heat exchanger 44, most of the ambient-temperature waste heat is removed from the engine at main ambient heat exchanger 46, and oscillations of the gas are thereby encouraged. The conversion of heat to acoustic power occurs in regenerator 48, which is structurally and functionally identical to that described in FIG. 1 for the free piston Stirling engine. Proper design of the acoustic network (including, principally, the feedback inertance 52 and compliance 54) causes the gas in the pores of regenerator 48 to move toward hot heat exchanger 44 while the pressure is high and toward main ambient heat exchanger 46 while the pressure is low. The oscillating thermal expansion and contraction of the gas in regenerator 48, attending its oscillating motion along the temperature gradient in the pores, is therefore temporally phased with respect to the oscillating pressure so that the thermal expansion occurs while the pressure is high and the thermal contraction occurs while the pressure is low.

As in the free piston Stirling engine, another way to view the operation of the thermoacoustic-Stirling hybrid engine is that acoustic power $\dot{E}_C$ flows into the ambient end of regenerator 48, is amplified by the temperature gradient in regenerator 48, and flows out of the hot end of regenerator 48. In FIG. 2, the acoustic power $\dot{E}_H$ flowing out of the hot end of the regenerator splits into two portions $\dot{E}_{fb}$ and $\dot{E}_{res}$ at the resonator junction 40, with the required amount $\dot{E}_C$ flowing into the ambient end of regenerator 48 to provide the original acoustic power for amplification, and the rest $\dot{E}_{res}$ being delivered to the right to the unspecified load 42. Hence, again, circulating acoustic power flows through regenerator 42 from ambient to hot and is amplified therein.

FIG. 3 shows a standing-wave thermoacoustic engine delivering acoustic power to an unspecified load 62 to the right. The standing-wave thermoacoustic engine creates acoustic power from heat in a somewhat different way than do regenerator-based engines such as those shown in FIGS. 1 and 2. High-temperature heat, such as from a flame, from nuclear fuel, or from ohmic heating, is added to the standing-wave thermoacoustic engine at hot heat exchanger 64, ambient-temperature waste heat is removed from the engine at the ambient heat exchanger 66, and oscillations of the gas are thereby encouraged. The conversion of heat to acoustic power occurs in stack 68, which is a solid matrix smoothly spanning the temperature difference between hot heat exchanger 64 and ambient heat exchanger 66 and containing pores through which the gas oscillates. The pores in stack 68 must be significantly larger than those in a regenerator operating under similar conditions, because excellent local thermal contact between the gas and the solid matrix is undesirable in a stack. Instead, deliberately imperfect thermal contact is necessary, and is typically provided by pore sizes of the same order, but slightly larger than, the thermal penetration depth in the gas at the operating frequency.

The oscillating thermal expansion and contraction of the gas in stack 68, attending its oscillating motion along the temperature gradient in the pores, is temporally phased with respect to the oscillating pressure so that the thermal expansion occurs while the pressure is high and the thermal contraction occurs while the pressure is low. However, this is achieved by fundamentally different circumstances than in the regenerators described for FIGS. 1 and 2. In stack 68, the temporal phasing between gas motion and gas pressure is such that the gas moves toward hot heat exchanger 64 while the pressure is rising (cf. "high" in a regenerator) and towards ambient heat exchanger 66 while the pressure is falling (cf. "low" in a regenerator). The deliberately imperfect thermal contact between the gas and the solid matrix of stack 68 is required in order to introduce a significant temporal phase shift, which does not exist in a regenerator, between gas motion and gas thermal expansion/contraction, so that the desired temporal phasing between oscillating pressure and oscillating thermal expansion/contraction is achieved.

Those skilled in the art understand that a stack does not rely on the presence of acoustic power to create more acoustic power. Instead, a stack requires that the temporal phasing between oscillating motion and oscillating pressure be substantially that of a standing wave, which, in principle, might carry no acoustic power, and the acoustic power flowing through the stack and/or created by the stack can flow in either direction, or can flow in both directions away from the center of the stack (as it does in the stack in FIG. 4 discussed below), without substantially altering the power-producing phenomena described above.

Those skilled in the art also understand that similar descriptions can be provided for regenerator-based and stack-based refrigerators. Similar to the regenerator-based engines, essential features of the regenerator-based refrigerators are that acoustic power must flow through the regenerator from ambient to cold, acoustic power is thereby attenuated, and the pores of the regenerator must be small enough to provide excellent thermal contact between the gas and the solid matrix. Similar to the stack-based engine, essential features of the stack-based refrigerator are that acoustic power can flow into the stack from either direction, acoustic power is absorbed in the stack, and the pores of the stack must be of a size that provides deliberately imperfect thermal contact between the gas and the solid matrix.

The term "ambient" temperature refers to the temperature at which waste heat is rejected, and need not always be a temperature near ordinary room temperature. For example, a cryogenic refrigerator intended to liquefy hydrogen at 20 Kelvin might reject its waste heat to a liquid-nitrogen stream at 77 Kelvin; for the purposes of this cryogenic refrigerator, "ambient" would be 77 Kelvin.

Note that, in all cases, a regenerator functions usefully only if it is sandwiched between two heat exchangers at different temperatures. Similarly, a stack functions usefully only if it is sandwiched between two heat exchangers at different temperatures. Hence, for brevity, the term a "stack unit" and a "regenerator unit" are used to describe such sandwiches of a stack between two heat exchangers and a regenerator between two heat exchangers, respectively. The building blocks for the invention described herein will therefore be regenerator units (engine or refrigerator) and stack units (engine or refrigerator).

None of the systems described above provides high efficiency and great reliability and low fabrication costs. For example, the free piston Stirling engine (FIG. 1) has high efficiency, but its moving parts (requiring tight seals between the piston and its surrounding cylinder and the displacer and its surrounding cylinder) compromise reliability and are responsible for high fabrication costs. The thermoacoustic-Stirling hybrid engine (FIG. 2) has high efficiency and high reliability, but the toroidal topology is needed for the circulation of acoustic power is responsible for high fabrication costs for two reasons. It is difficult to provide flexibility in the toroidal pressure vessel to accommodate the thermal expansion of the hot heat exchanger 44 and surrounding hot parts, and an adjustable jet pump 50 (shown in FIG. 2) must be provided to suppress Gedeon streaming around the torus, which would otherwise convect significant heat away from hot heat exchanger 44. Furthermore, there is published evidence that thermoacoustic-Stirling hybrid refrigerators can suffer from dramatic instability with respect to Gedeon streaming, so that an adjustable jet pump 50 would require continuous feedback-controlled adjustment. Finally, the stack-based standing-wave thermoacoustic engine (FIG. 3) is reliable and costs little to fabricate, but its efficiency is only about ⅔ that of the regenerator-based systems.

Accordingly, it is desirable to provide acoustic heat engines and refrigerators having, simultaneously, the high efficiency of regenerator-based systems, the low fabrication costs of no-moving-parts non-toroidal stack-based systems, and the reliability of no-moving-parts regenerator-based or stack-based systems.

Various advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The present invention includes a thermoacoustic device with a resonator system defining at least one region of high specific acoustic impedance in an acoustic wave within the resonator system. A plurality of thermoacoustic units are cascaded together within the region of high specific acoustic impedance, where at least one of the thermoacoustic units is a regenerator unit.

In one aspect of the present invention, at least two regenerator units are connected in series within the region of high specific acoustic impedance. In another aspect, a plurality of regions of high specific impedance are placed along a common axis. In a particular embodiment, at least two of the plurality of regions of high specific impedance are separated by an acoustic side branch therebetween to provide an extended region of high specific acoustic impedance.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION

Figure 1:
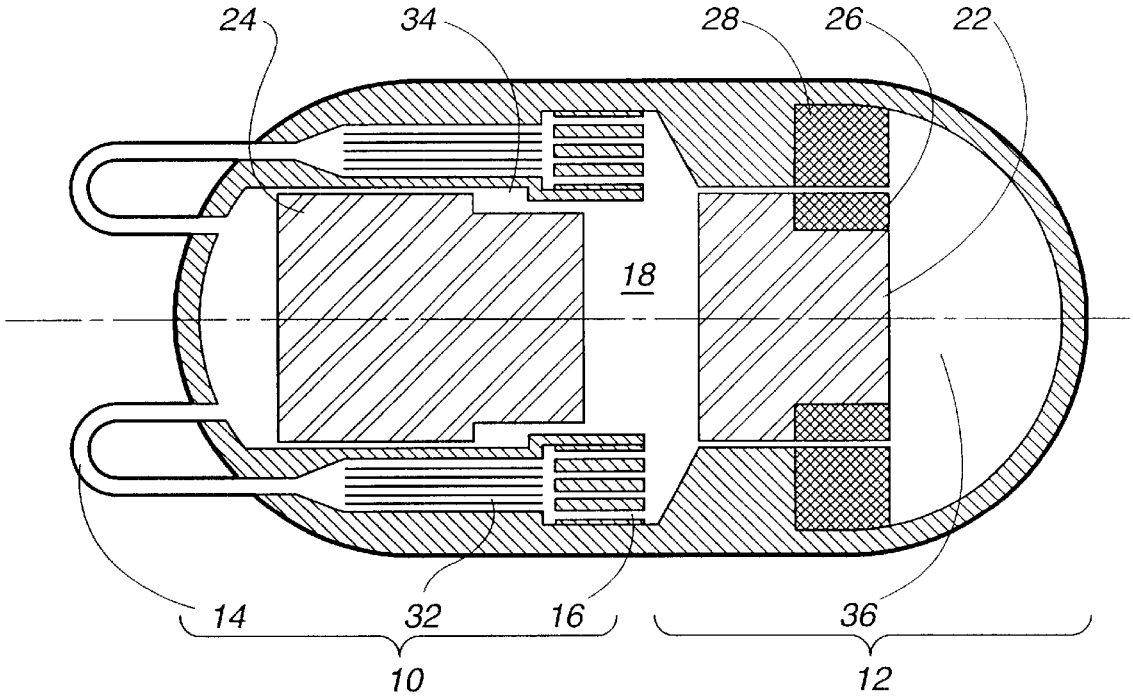
Fig. 1 (Prior Art)
FIG. 1 schematically depicts a prior art free piston Stirling engine, a regenerator-based system.
Figure 2:
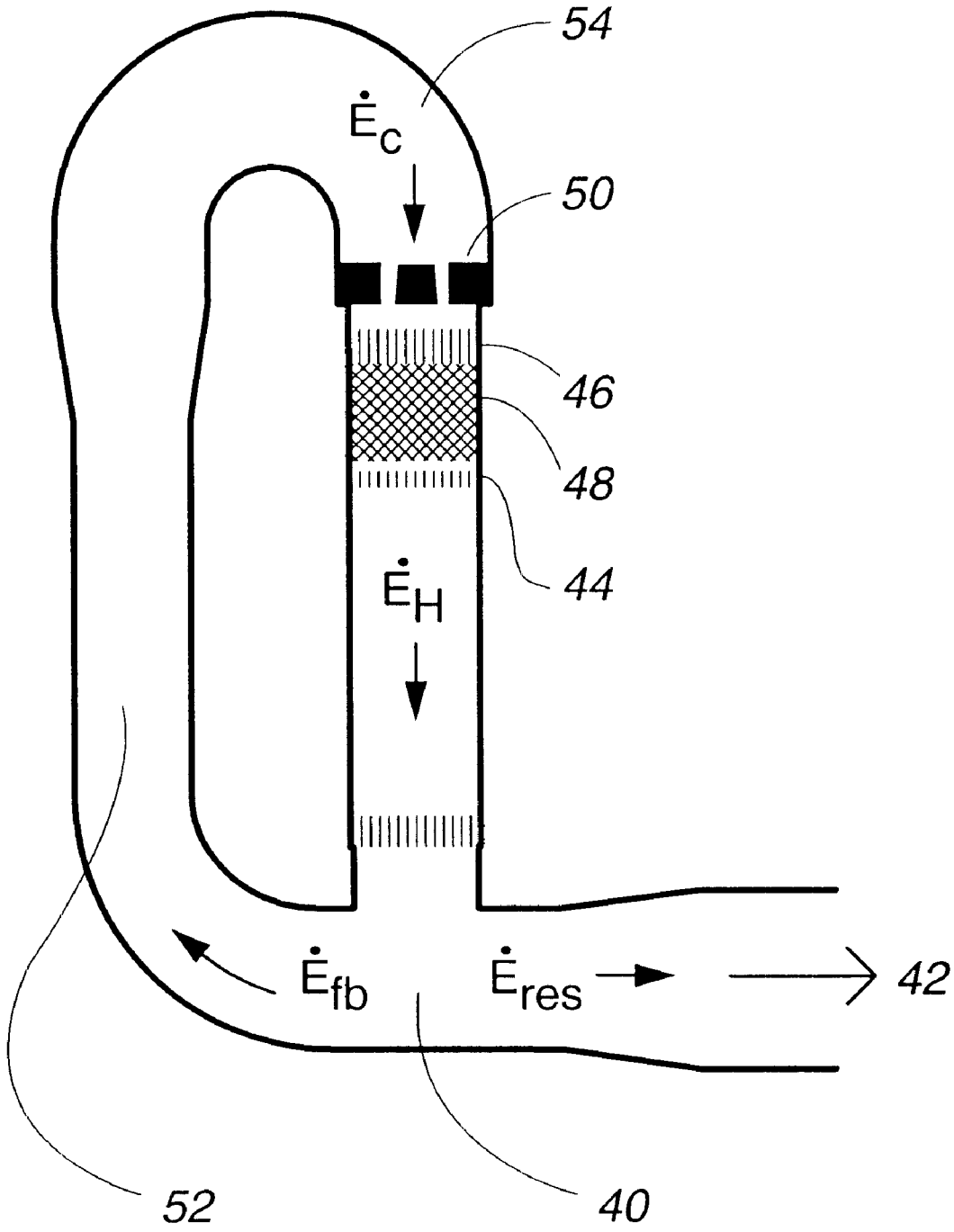
Fig. 2 (Prior Art)
FIG. 2 schematically depicts a prior art thermoacoustic-Stirling hybrid engine, another regenerator-based system.
Figure 3:
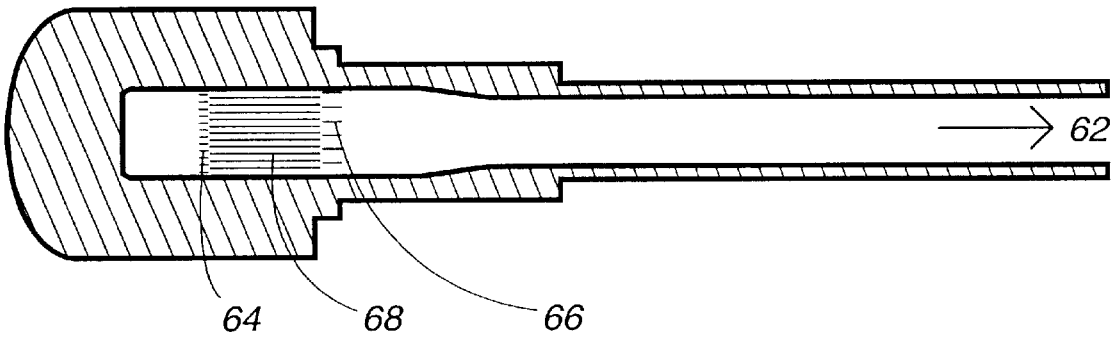
Fig. 3 (Prior Art)
FIG. 3 schematically depicts a prior art standing-wave thermoacoustic engine, a stack-based system.
Figure 4A:
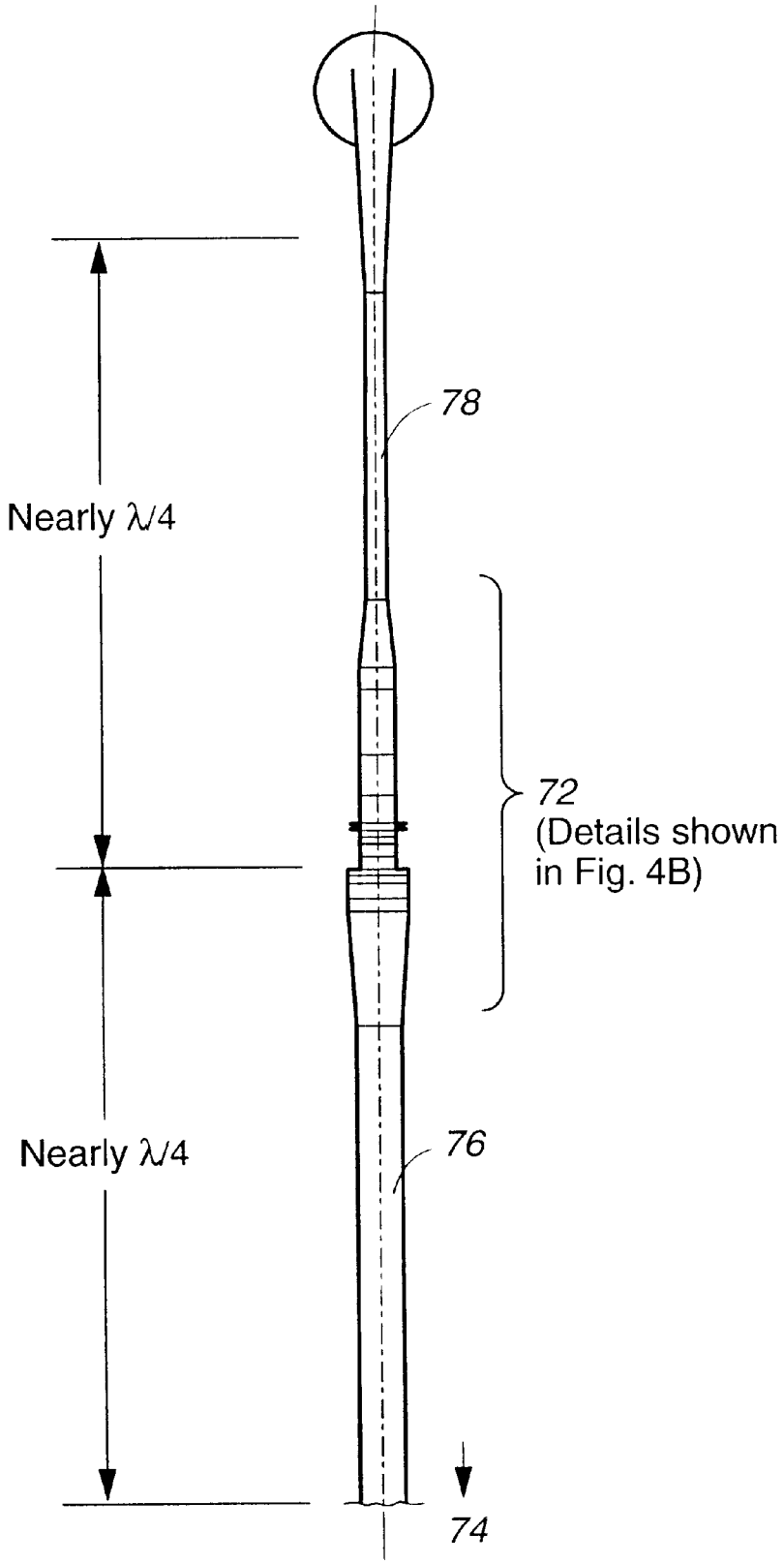
FIGS. 4A and 4B schematically depict an exemplary cascaded thermoacoustic system according to the present invention comprising one stack engine unit and two regenerator engine units, all in series.
Figure 4B:
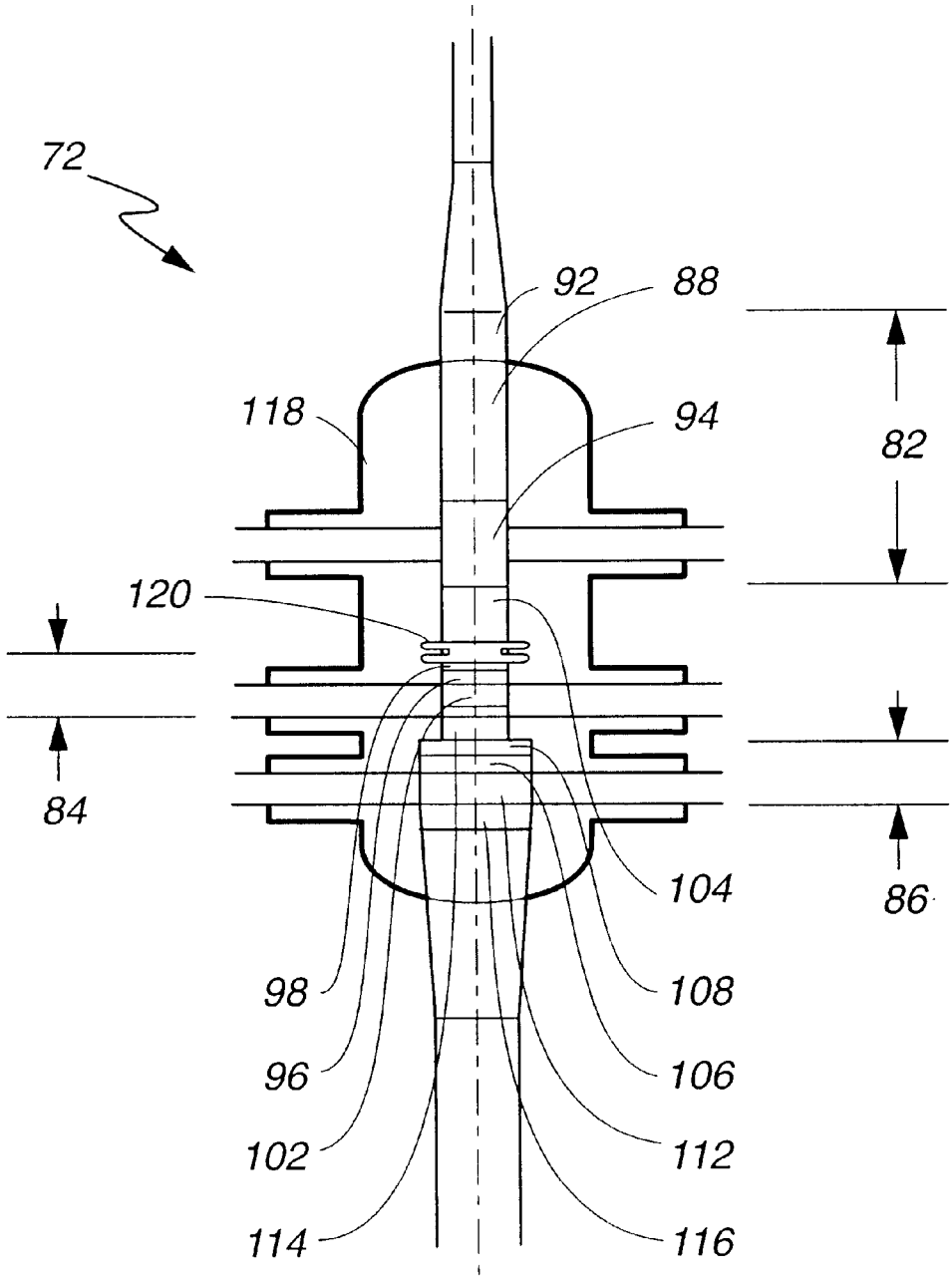

In accordance with the present invention, various stack and regenerator units, with optional pistons, are placed in a cascading relationship. FIGS. 4A and 4B illustrate one example that has been investigated in detail using the computer implemented DeltaE simulation code. A cascade 72 provides, in series, (1st) a stack unit 82 functioning as an engine, (2nd) a first regenerator unit 84 functioning as an engine, and (3rd) a second regenerator unit 86 functioning as an engine, which finally delivers acoustic power to a load 74 (e.g., a refrigerator or a linear alternator) below.

Stack unit 82 includes stack 88 with input ambient heat exchanger 92 on the top side and hot heat exchanger 94 on the bottom side. Regenerator unit 84 is separated from stack unit 82 by thermal buffer tube 104, as explained below, and includes regenerator 96 with ambient heat exchanger 98 on the top side and hot heat exchanger 102 on the bottom side. A second regenerator unit 86 is separated from regenerator unit 84 by thermal buffer tube 114. Regenerator 106 has ambient heat exchanger 108 on the top side and hot heat exchanger 112 on the bottom side. Hot heat exchanger 112 is connected to an output resonator through thermal buffer tube 116. As used herein, "top" and "bottom" sides are well defined, because thermal buffer tubes 104, 114, 116 have to be hot side up for gravity stability.

The space inside of pressure housing 118 and outside of stack unit 82, regenerator units 84 and 86, and thermal buffer tubes 104, 114, and 116 may be filled with a thermally insulating material such as ceramic fiber and pressurized to the average thermoacoustic gas pressure. Thus, the stack, regenerator, and thermal buffer tube walls can be thin because they need only to support the oscillating part of the pressure, thereby reducing the heat leaks from hot to ambient. Bellows 120 accommodates axial thermal expansion of stack unit 82, regenerator units 84 and 86, and thermal buffer tubes 104, 114, and 116 within the fixed axial length of pressure housing 118.

The qualitative descriptions presented herein are intended to teach the invention to those skilled in the art. The DeltaE computer code that is used to simulate embodiments of the present invention has been experimentally validated, has been broadly distributed, and is in widespread use among those skilled in the art. The User Guide describes its algorithms in detail and is available at www.lanl.gov/thermoacoustics, incorporated herein by reference. Hence, DeltaE simulations were used to provide a quantitatively accurate depiction of the detailed acoustic and thermodynamic processes of the present invention, e.g., such as depicted as an exemplary embodiment in FIGS. 4A and 4B. Those skilled in the art will recognize that DeltaE simulations can readily be used to explore other embodiments of the invention, such as cascaded refrigerators and the like.

The present invention involves the location of the regenerator unit(s) and/or stack unit(s) in the acoustic wave. It is known to those skilled in the art that both stacks and regenerators operate best at locations of high specific acoustic impedance, where specific acoustic impedance is the ratio of the amplitude of the oscillating pressure to the amplitude of the oscillating velocity. As used herein, a "high specific acoustic impedance" is greater than the product of gas density and gas sound speed, usually by roughly an order of magnitude (e.g., typically 30 for regenerator units and 5 for stack units). See, e.g., "Thermoacoustics: a unifying perspective for some engines and refrigerators," G. W. Swift, advanced textbook to be published by the Acoustical Society of America in 2002; draft available before the publication date at www.lanl.gov/thermoacoustics/, incorporated herein by reference. It is taught in U.S. Pat. No. 4,355,517 to Ceperley, U.S. Pat. No. 4,398,398 to Wheatley et al., and U.S. Pat. No. 4,489,553 to Wheatley et al. that this condition requires putting the stacks and regenerators in a wave with substantial standing-wave character and near the oscillating pressure maximum of that wave. For example, to set this value equal to 5 (typical for a stack unit) in a standing wave described by $$p(x,t)=P_o \cos(2\pi x/\lambda)\cos(2\pi ft),$$

$$u(x,t)=(P_o/\rho a)\sin(2\pi x/\lambda)\sin(2\pi ft)$$

requires that $\tan(2\pi x/\lambda)=1/5$, i.e., $x/\lambda=0.03$. $P_o$ is the amplitude of the pressure oscillation at the location of its maximum, p(x,t) and u(x,t) are the oscillating pressure and velocity as functions of position x and time t (with x=0 at the location of the maximum in oscillating pressure), ρ is the gas density, a is the gas sound speed, f is the frequency of the oscillations, and $\lambda=a/f$ is the wavelength.

The locations of the stack unit 82 and the two regenerator units 84, 86 in FIG. 4B straddle such an oscillating pressure maximum in the acoustic device comprised of wave tubes 76, 78 and cascade 72, so that the three units 82, 84, 86 are within one region of high specific acoustic impedance. In FIG. 4A, that region arises because the piping segments containing cascade 72, upper wave tube 78, and lower wave tube 76 are similar to two nearly quarter-wave resonators of different cross sectional areas, with velocity maxima at the upper end of upper wave tube 78 and at the lower end of lower wave tube 76.

The term "nearly quarter wave" is used because Hofler [T. J. Hofler, "Thermoacoustic refrigerator design and performance," 1986, Physics department thesis, University of California, San Diego] taught that a desired acoustic impedance could be maintained at a location of a stack (or regenerator), while less acoustic power is dissipated in the attached resonator, by providing resonator geometry with slightly reduced cross sectional area and slightly reduced length in the region of high velocity. These reductions are typically between 25% and 50%. The reduced surface area resulting from these geometry reductions leads to less boundary-layer acoustic power dissipation. Reducing the dimensions too much, however, raises velocities enough to raise dissipation again. Hofler, supra, teaches the optimum dimensions giving minimum power dissipation. For clarity, these shape details are not shown in FIGS. 5A–F.

The present invention provides for the efficient creation, amplification, or, in the case of refrigerators, use of acoustic power. Regenerator units are more efficient than stack units, so it is desirable to use regenerator units as much as possible. However, regenerator engine units require injection of acoustic power at the ambient end, which leads to the use of pistons, displacers and toroidal acoustic networks in prior art engines. Similarly, regenerator refrigerator units require removal of acoustic power at the cold end, which leads to the use of displacers, toroidal acoustic networks, or dissipative orifices in prior art refrigerators.

In the present invention, cascaded regenerator engine units can be used to provide great amplification of a small amount of acoustic power that is created by a small stack unit or a small oscillating piston. By using multiple cascaded regenerator engine units, it is possible to use a small stack engine unit or a small, driven oscillating piston or even a loudspeaker to create the initial acoustic power (or, in the case of cascaded refrigerators, to consume the final acoustic power), so the comparatively low efficiency of the stack unit or the comparatively high cost of the oscillating piston or the comparatively low efficiency of the loudspeaker have a small impact on the entire system's efficiency or cost.

For example, the simulation of the system shown in FIGS. 4A and 4B showed that stack unit 82 creates 14 kW of acoustic power, and delivers 12 kW of it to first regenerator unit 84 (the other 2 kW flowing up to feed the unavoidable dissipation in the upper portions of the resonator), first regenerator unit 84 amplifies that 12 kW to 26 kW, which it delivers to second regenerator unit 86, and second regenerator unit 86 amplifies that 26 kW to 58 kW. Thus, of the 58 kW available to a load, only 12 kW was generated by the relatively inefficient stack unit 82; the remaining 46 kW was generated in the more efficient regenerator units 84, 86.

Figures 5A, 5B, 5C, 5D, 5E, 5F:
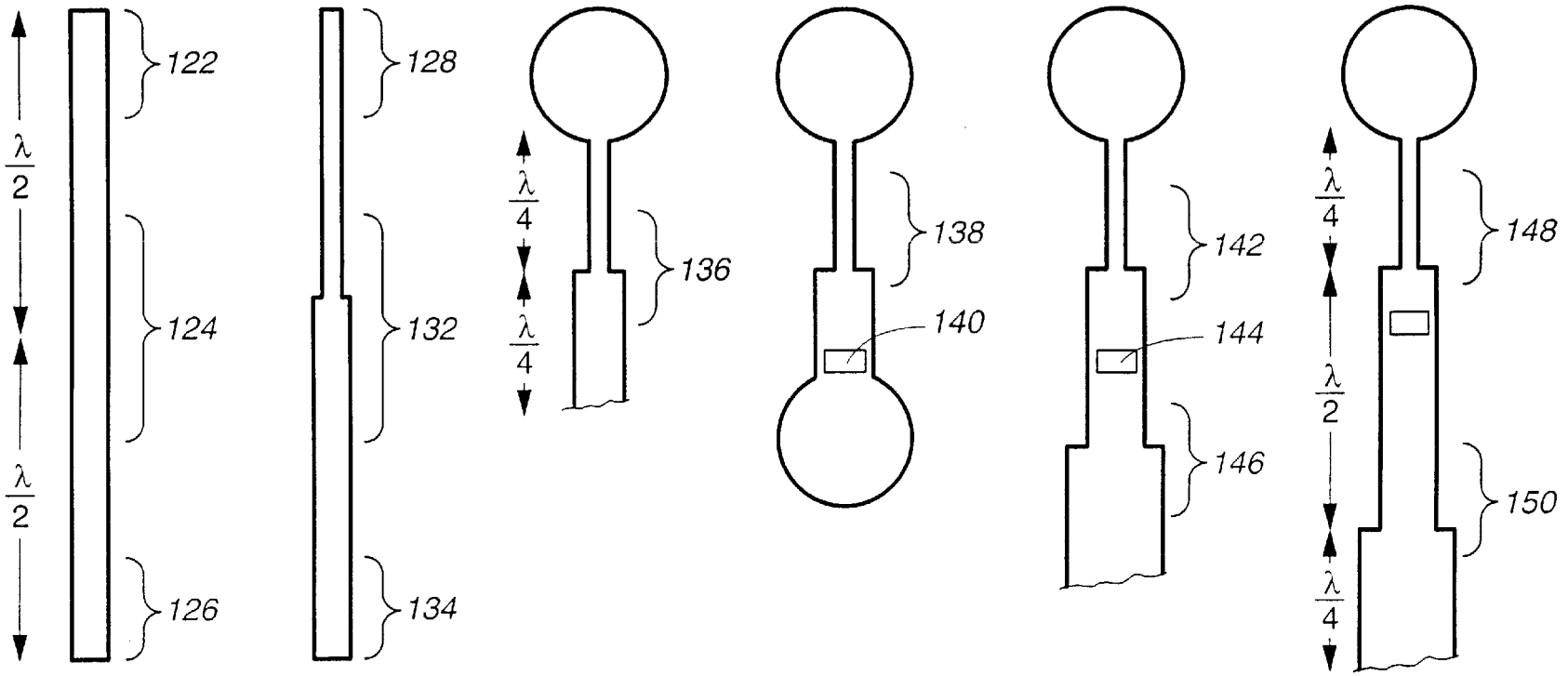
FIGS. 5A–F schematically depict some examples of resonators with locations having a high specific acoustic impedance.

Other resonator geometries, including those shown in FIGS. 5A–F, can accomplish the same acoustics as the resonator shown in FIG. 4A. FIGS. 5A and 5B show resonators with lengths equal to one acoustic wavelength, with a uniform cross sectional area or a cross sectional area having a transition at the midpoint, respectively. The ends of these resonators are closed, so regions 122, 124, 126, 128, 132, and 134 are regions of high specific acoustic impedance. Any or all of these regions are suitable locations for stack units and regenerator units, according to the present invention. For example, in FIG. 5B, region 128 could contain a stack engine unit, region 132 could contain a second stack engine unit and one or two engine regenerator units, and region 134 could contain an additional regenerator engine unit. The bottom end of the resonator could then be the location of a noncompliant linear alternator to convert the acoustic power created by all the engine units into electricity. The area change shown in FIG. 5B can accommodate units of differing cross sectional areas, which is useful when the units handle differing amounts of power.

FIG. 5C is a depiction of a resonator of the type used in FIG. 4A, in the simplified scheme of FIGS. 5A–F in which the shape details of the resonator are not shown. Region 136 of high specific acoustic impedance is the location suitable for a cascade, such as cascade 72 of FIG. 4.

FIG. 5D shows that an electroacoustic power transducer 140 can be located just below region 138 of high specific acoustic impedance. If transducer 140 is a motor, then region 138 can contain a cascade of refrigerator units. If transducer 140 is an alternator, then region 138 can contain a cascade of engine units.

FIGS. 5E and 5F show two additional, related ways to create more than one region of high specific acoustic impedance in a resonator. The resonator in FIG. 5F is an extended version of the resonator in FIG. 5C, and can be extended indefinitely: Each extension by $\lambda/2$ adds a new region of high specific acoustic impedance wherein stack units or regenerator units can be located. Region 148 in FIG. 5F corresponds to region 136 in FIG. 5C, and region 150 in FIG. 5F is a new region of high specific acoustic impedance, separated from region 148 by approximately $\lambda/2$. FIG. 5E shows a shorter way to create more than one region of high specific acoustic impedance. The central zone of any of the resonator portions marked "$\lambda/2$" in FIGS. 5A, 5B, and 5F is essentially inertial in character, so an inertially massive free piston (usually not attached to a power transducer) can provide the same acoustic-impedance transformation if shorter height is more important than avoidance of moving parts. Free piston 144 in FIG. 5E replaces the central zone of the resonator portion marked "$\lambda/2$" in FIG. 5F.

An embodiment that cascades a stack unit and three regenerator units within a single region of high specific acoustic impedance as shown in any of FIGS. 5A–F has been simulated. At some larger number of units, however, there will be insufficient space within that region of the wave to accommodate all the units, and additional cascaded units, if desired, would have to be located in other regions of high specific acoustic impedance, in resonators having more than one such region, such as those shown in FIGS. 5A, 5B, 5E and 5F.

Figures 6A, 6B, 6C:
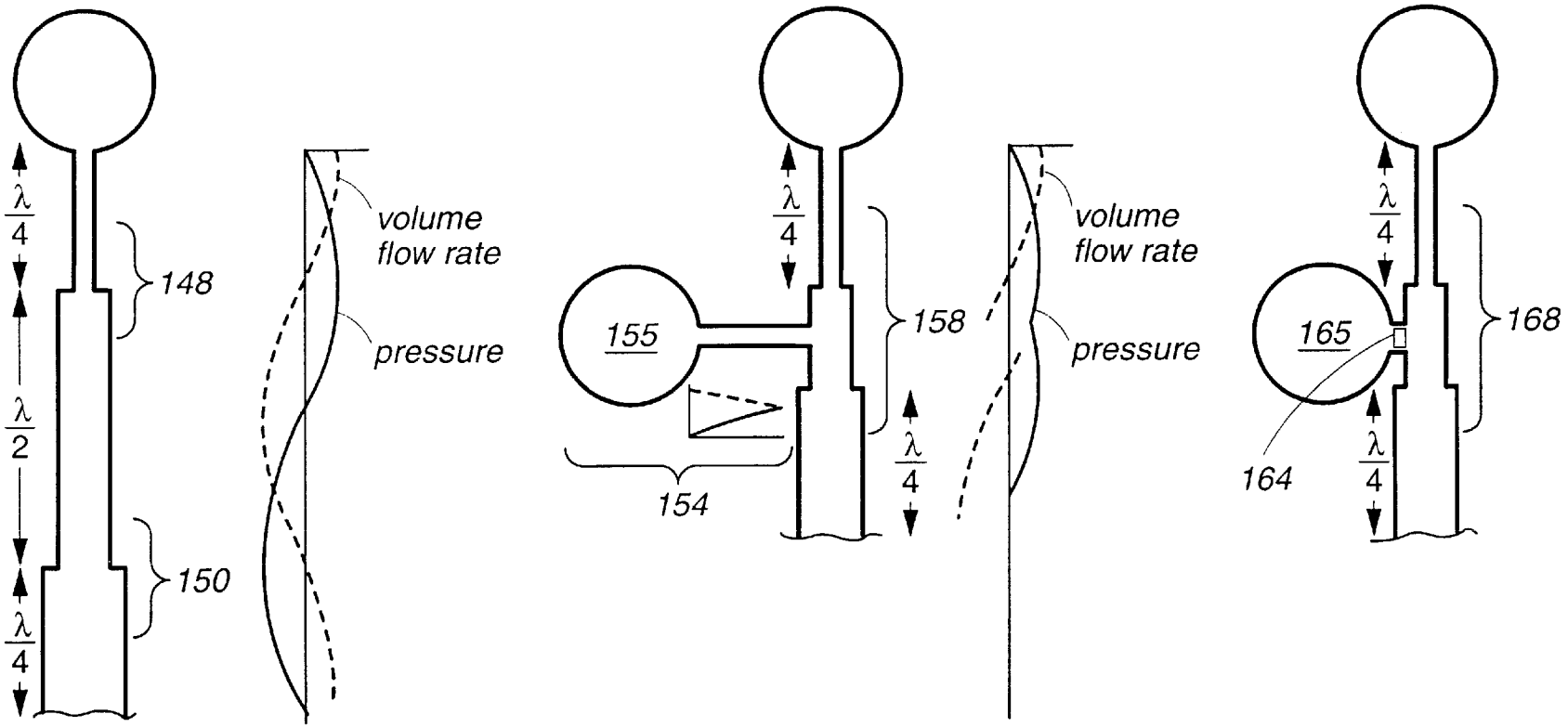
FIG. 6A schematically depicts the acoustic wave associated with the resonator of FIG. 5F.
FIGS. 6B and 6C schematically depict two examples of resonators using side branches to create axially extended locations having a high specific acoustic impedance.

Alternatively, side branches can be used to create axially extended regions of high specific acoustic impedance, where a side branch is generally orthogonal to the axis of a resonator. FIG. 6A shows the resonator of FIG. 5F, along with a graph showing the in-phase part of the oscillating pressure and the out-of-phase part of the oscillating volume flow rate (i.e., the integral, over the cross sectional area, of the velocity) as functions of axial position along the resonator. The two regions 148, 150 of high specific acoustic impedance are axially separated by a distance that is a large fraction of $\lambda/2$, which might be inconveniently far in some applications.

FIG. 6B shows the use of an acoustic side branch 154 that creates an axially extended region 158 of high specific acoustic impedance, whose axial length is the sum of the axial lengths of regions 148 and 150. The graphs show how to design such a side branch: If the magnitude of the pressure oscillation (solid lines) at the 3-way junction is $P_J$ and the magnitude of the oscillating volume flow rate (dashed lines) flowing into the junction from above is $-U_J$, then the side branch must be designed to provide $+2U_J$ to the 3-way junction. This can be done in many ways. If the bulb 155 at the end of acoustic side branch 154 is very large, then the cross sectional area A and length L of the side-branch tube must satisfy $P_J/2U_J=(\rho a/A)\tan(2\pi L/\lambda)$. From among the many sets A, L of solutions to this equation, one can be chosen to minimize size or dissipation or some other figure of merit. The side branch can also be implemented with a bulb 165 and free piston 164, as shown in FIG. 6C.

Examination of the graphs in FIG. 6B shows that a region of high specific acoustic impedance of even greater axial length can be created by periodically attaching additional side branches to such a resonator.

Two oppositely directed side branches, at the same axial location, can also be used to create an extended region of high specific acoustic impedance, if vibration cancellation in the horizontal direction is important.

Further, the present invention acts to prevent heat leak from the hot end of one unit to the ambient end of the adjacent unit in the case of engines and the prevention of heat leak from the ambient end of one unit to the cold end of the adjacent unit in the case of refrigerators. Both forms of heat leak reduce system efficiency. At each such location between units, it is necessary to provide a thermal buffer tube for thermal isolation. Thermal buffer tubes have been described in the context of thermoacoustic-Stirling hybrid engines and refrigerators in U.S. Pat. No. 6,032,464 to Swift et al., and they are very well known as "pulse tubes" in the context of orifice pulse tube refrigerators. Ideally, a slug of the gas in the axially central portion of a thermal buffer tube experiences adiabatic pressure oscillations and temperature-stratified velocity/motion oscillations, so that this slug of gas behaves like an axially compressible, but otherwise intact, thermally insulating oscillating piston. Axial internal motion of any portion of the gas in this slug relative to other gas in this slug should be avoided, because such motion convects heat from one end of the slug to the other. Such undesirable axial internal motion can be caused by gravity-driven convection, by inadequate flow straightening at the ends of the thermal buffer tube causing jets to extend into the central portion of the thermal buffer tube, or by Rayleigh streaming. In all of the figures herein, "up" and "down" have been chosen for stability of the thermal buffer tubes against gravity-driven convection.

Clearly, if the length of the thermal buffer tube is shorter than the peak-to-peak displacement of the gas therein, no slug of gas as described in the previous paragraph can exist, because no slug of gas remains within the thermal buffer tube throughout a full cycle of the oscillations. Hence, the thermal buffer tube is preferably longer than the peak-to-peak displacement of the gas therein. Good design practice among those skilled in the arts of orifice pulse tube refrigerators and thermoacoustic-Stirling hybrid engines typically calls for thermal buffer tubes to have a length equal to or greater than approximately 3 peak-to-peak gas displacement amplitudes.

Hence, the present invention includes thermal buffer tubes between all units when the heat exchangers separated by such thermal buffer tubes have unequal temperatures.

Thermal buffer tubes sometimes require a taper to suppress Rayleigh streaming as described in U.S. Pat. No. 5,953,920 to Olson et al. In some situations in the present invention, the thermal buffer tube is so short and broad, and the required taper is so extreme, that the assumptions on which taper calculation of the '920 patent was based break down, and, in particular, flow separation at the wall might occur. This may be solved by subdividing the area of the tapered thermal buffer tube with a number of louvers so that a number of thermal buffer tubes in parallel are effectively formed, each having a taper for which the '920 patent teaching is applicable Such a thermal buffer tube is not needed where a stack unit functioning as an engine is in the latter portion of one region of high specific acoustic impedance and a regenerator unit is in the closest neighboring region of high specific acoustic impedance. In this case, a thermal buffer tube between the ambient heat exchanger of the stack unit and the ambient heat exchanger of the regenerator unit is unnecessary, because it spans no temperature difference.

It should be noted that the exact location of the pressure maximum in the system can depend on gas temperatures in the high-velocity portions of the resonator. This condition can be exploited for fine tuning of acoustic conditions at a stack unit or regenerator unit (Anthony J. Lesperance, "Hardware modifications and instrumentation of the thermoacoustically driven thermoacoustic refrigerator," Master's thesis, September 1997, Engineering Acoustics Department, US Naval Postgraduate School, Monterey Calif. 93943) by controlling the temperature of one high-velocity portion of the resonator with an electrical heater. The temperature changes needed to effect this control are small, typically 30° C. The same control can be obtained by other heating means or by cooling means, such as cooling water or waste heat from a burner; or by variable-geometry resonators.

The above discussion is directed to cascaded engines, but the same principles apply to refrigerators. Two or three regenerator refrigerator units can be cascaded if the refrigerator units do not span too large a temperature difference. However, DeltaE simulation shows that cascading two cryogenic regenerator refrigerator units within a single region of high specific acoustic impedance leads to rather low efficiency for one or both of the refrigerators, because each such cryogenic unit demands a substantial fraction of a wavelength in the wave and the efficiency of cryogenic regenerator units is fairly sensitive to the specific acoustic impedance. A stack refrigerator unit following a regenerator refrigerator unit also looks useful. As for the engine cascades, thermal buffer tubes between refrigerator units are required.

Figure 7A:
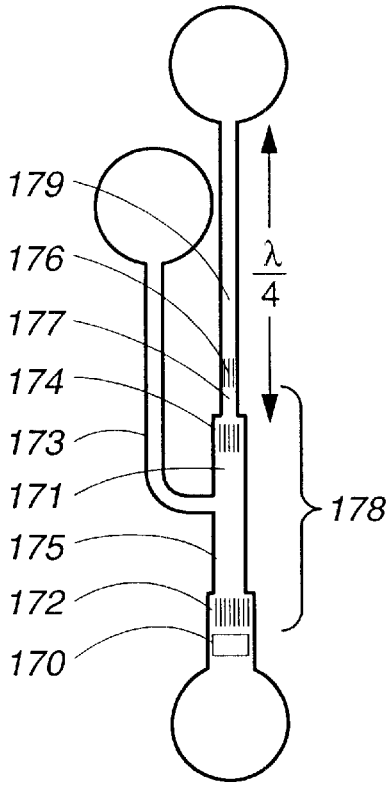
FIGS. 7A and 7B schematically depict two complete thermoacoustic systems using the present invention.
Figure 7B:
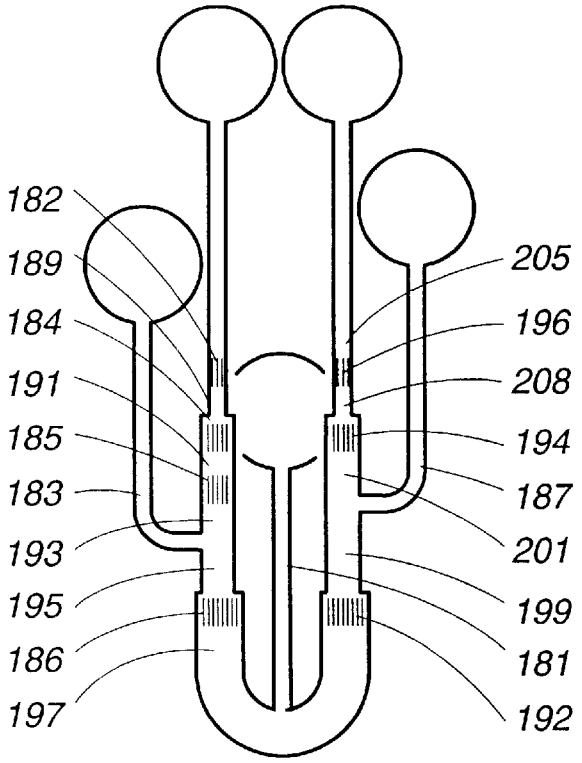

FIGS. 7A and 7B schematically depict two examples of how the cascade ideas disclosed here can be integrated into complete thermoacoustic systems.

FIG. 7A shows a thermoacoustic refrigerator system driven by a linear motor 170. The resonator arrangement, especially side branch 173 and the $\lambda/4$ portion, create an axially extended region 178 of high specific acoustic impedance. From bottom to top, in region 178 are first regenerator refrigerator unit 172, a thermal buffer tube 175, the junction to side branch 173, a short inertial section 171 of wave tube to raise the pressure amplitude slightly, second regenerator refrigerator unit 174, another thermal buffer tube 177, and stack refrigerator unit 176. Another thermal buffer tube 179 above stack refrigerator unit 176 can be outside of region 178. Acoustic power flows upward through, and is consumed by, all three refrigerator units 172, 174, 176. All three refrigerator units 172, 174, 176 have their cold heat exchangers on top and their ambient heat exchangers on the bottom, and, hence, all three thermal buffer tubes are gravitationally stable.

FIG. 7B shows a combined thermoacoustic engine and refrigerator system, such as might be used to cryogenically liquefy nitrogen by using combustion of natural gas as a source of power. The resonator arrangement includes three side branches 181,183,187, creating an axially extended region of high specific acoustic impedance that contains, in sequence from the top left, stack engine unit 182, a thermal buffer tube 189, first regenerator engine unit 184, another thermal buffer tube 191, second regenerator engine unit 185, another thermal buffer tube 193, a junction to side branch 183, a short inertial section 195 of wave tube to raise the pressure amplitude slightly, third regenerator engine unit 186, another thermal buffer tube 197, a junction to side branch 181, first regenerator refrigerator unit 192, another thermal buffer tube 199, a junction to side branch 187, another short inertial section 201 of wave tube to raise the pressure amplitude slightly, second regenerator refrigerator unit 194, another thermal buffer tube 208, and stack refrigerator unit 196. Another thermal buffer tube 205 above stack refrigerator unit 196 can be outside of the region of high specific acoustic impedance.

Acoustic power is created by stack engine unit 182, flows downward through and is amplified by the three regenerator engine units 184, 185, 186, flows upward through and is attenuated by the two regenerator refrigerator units 192, 194, and flows upward into and is consumed by stack refrigerator unit 196. All three refrigerator units have their cold heat exchangers on top and their ambient heat exchangers on the bottom, and all four engine units have their ambient heat exchangers on top and their hot heat exchangers on the bottom; hence, all thermal buffer tubes are gravitationally stable.

The above discussion is generally directed to regenerator units and stack units in which the oscillating fluid flows in all portions of each such unit are essentially parallel, such as through the short dimension of a regenerator unit shaped like a hockey puck. However, the same principles apply to stacks and regenerators shaped like a cylindrical annulus, with the oscillating flow in the radial direction; and to other geometries.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A thermoacoustic device comprising:

a resonator system defining at least one region of high specific acoustic impedance in an acoustic wave within the resonator system;

a plurality of thermoacoustic units cascaded together within the region of high specific acoustic impedance , where at least one of the thermoacoustic units is a regenerator unit.

2. The thermoacoustic device of claim 1, wherein other ones of the thermoacoustic units are selected from the group consisting of regenerator engine units, stack engine units, regenerator refrigerator units, and stack refrigerator units.

3. The thermoacoustic device of claim 1, where the plurality of thermoacoustic units includes at least two engine units or at least two refrigerator units.

4. The thermoacoustic device of claim 1, wherein adjacent ones of the thermoacoustic units are separated by thermal buffer tubes.

5. The thermoacoustic device of claim 2, wherein adjacent ones of the thermoacoustic units are separated by thermal buffer tubes.

6. The thermoacoustic device of claim 3, where adjacent ones of the thermoacoustic units are separated by thermal buffer tubes.

7. A thermoacoustic device comprising:

a resonator system defining at least one region of high specific acoustic impedance of an acoustic wave within the resonator system;

at least two regenerator units connected in series within the region of high specific acoustic impedance.

8. The thermoacoustic device of claim 7, wherein adjacent regenerator units are connected with a thermal buffer tube.

9. The thermoacoustic device of claim 7, further including a stack unit connected to an end of one of the regenerator units for creating or absorbing acoustic power input to or output from the connected regenerator unit, respectively.

10. The thermoacoustic device of claim 9, further including a thermal buffer tube connecting the stack unit with the end of one of the regenerator units.

11. The thermoacoustic device of claim 7, wherein the at least one region of high specific acoustic impedance is a plurality of regions of high specific impedance along a common axis.

12. The thermoacoustic device of claim 11, wherein at least two of the plurality of regions of high specific impedance are separated by an acoustic side branch therebetween.

13. The thermoacoustic device of claim 12, wherein adjacent regenerator units are connected with a thermal buffer tube.

14. The thermoacoustic device of claim 12, further including a stack unit connected to an end of one of the regenerator units for creating or absorbing acoustic power input to or output from the connected regenerator unit, respectively.

15. The thermoacoustic device of claim 14, further including a thermal buffer tube connecting the stack unit with an end of one of the regenerator units.

16. The thermoacoustic device of claim 11, wherein at least one of the plurality of regions of high specific impedance contains thermoacoustic engine units and at least one other region of the plurality of regions of high specific impedance contains at least one thermoacoustic refrigerator unit.

17. The thermoscoustic device of claim 7, further including an oscillating piston to provide input acoustic power to the thermoacoustic device.

18. The thermoacoustic device of claim 12, further including an oscillating piston to provide input acoustic power to the thermoacoustic device.

* * * * *